US005394056A

United States Patent [19]

Forman et al.

[11] Patent Number: 5,394,056

[45] Date of Patent: Feb. 28, 1995

[54] OPENING OF CAPSULE INSIDE SEALED LAMP

[75] Inventors: Roger A. Forman, Macedonia, Ohio; Eric G. Thaler, Schenectady, N.Y.

[73] Assignee: General Electric Company, Schenectady, N.Y.

[21] Appl. No.: 43,919

[22] Filed: Apr. 7, 1993

[51] Int. Cl.[6] ..... H01J 61/24

[52] U.S. Cl. ..... 313/547; 313/546; 313/550; 313/558; 313/559; 313/561; 313/490; 313/565; 337/27; 337/333; 337/349; 337/378

[58] Field of Search ..... 313/547, 546, 550, 558, 313/559, 561, 490, 565; 337/22, 27, 333, 349, 378

[56] References Cited

U.S. PATENT DOCUMENTS

| | | | |
|---|---|---|---|
| 2,415,895 | 2/1947 | Lopez | 316/14 |
| 2,991,387 | 7/1961 | McCauley | 313/109.5 |
| 3,215,892 | 11/1965 | Waymouth | 313/546 |
| 3,230,027 | 1/1966 | Mayer | 316/16 |
| 3,300,037 | 1/1967 | De Santis | 206/4 |
| 3,619,697 | 11/1971 | Evans | 313/490 |
| 3,764,842 | 10/1973 | Ridders et al. | 313/177 |
| 3,794,402 | 2/1974 | Ridders et al. | 316/14 |
| 3,794,403 | 2/1974 | Ridders et al. | 316/30 |
| 4,182,971 | 1/1980 | Cassidy et al. | 313/177 |
| 4,335,326 | 6/1982 | Latassa et al. | 313/177 |
| 4,823,047 | 4/1989 | Holmes et al. | 313/546 |
| 5,006,755 | 4/1991 | Wittmann et al. | 313/490 |

FOREIGN PATENT DOCUMENTS

| | | | |
|---|---|---|---|
| 54-135466 | 10/1979 | Japan | 313/546 |

*Primary Examiner*—Donald J. Yusko
*Assistant Examiner*—Matthew J. Esserman
*Attorney, Agent, or Firm*—Edward M. Corcoran; Stanley C. Corwin

[57] ABSTRACT

A capsule containing a precise amount of a substance such as mercury is mounted in an electrode mount assembly on a temperature sensitive member. At elevated temperatures the capsule is moved away from lamp components by the temperature sensitive member to preclude inadvertent release of the mercury into the sealed lamp. After the lamp has cooled, the temperature sensitive member urges the capsule into biased engagement with a cutting wire so that upon supply of current thereto the capsule is melted and opened to release the mercury.

14 Claims, 2 Drawing Sheets

Fig. 2
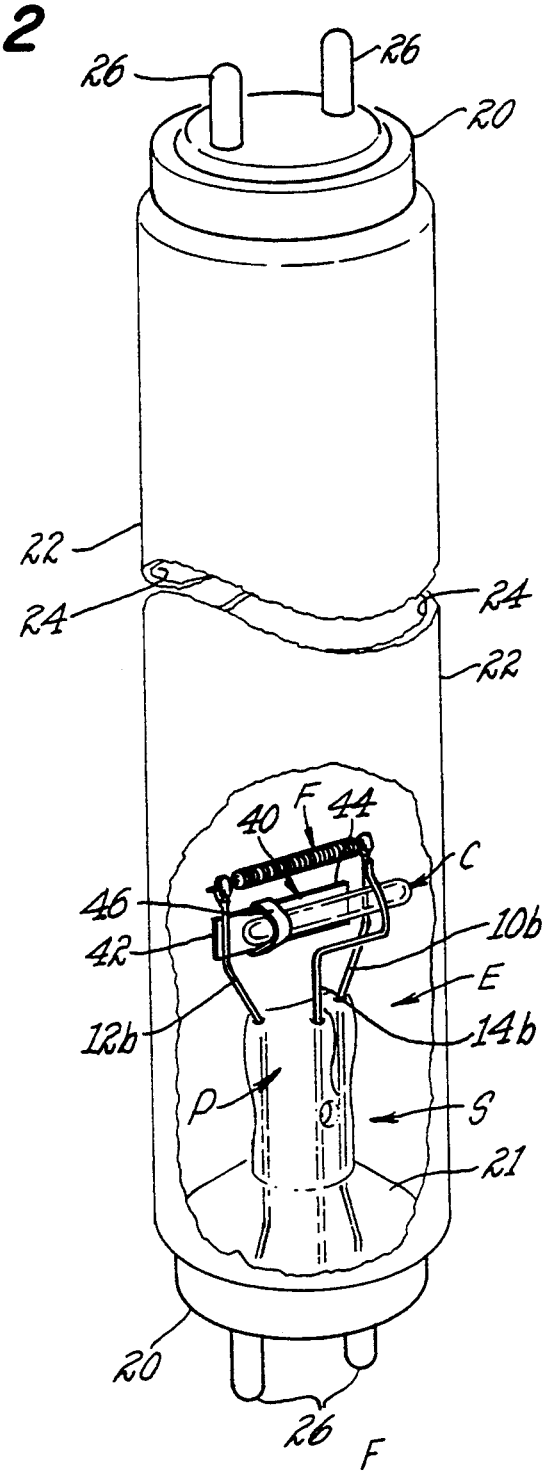
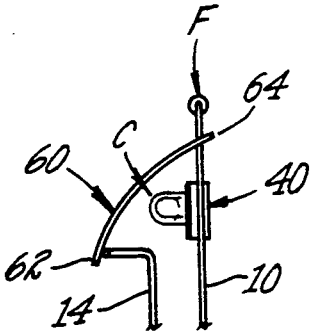
Fig. 3
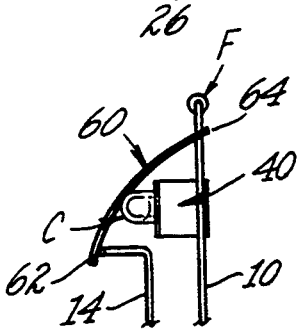
Fig. 4
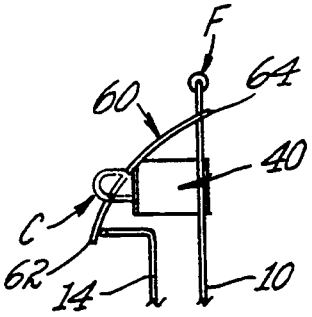
Fig. 5

OPENING OF CAPSULE INSIDE SEALED LAMP

BACKGROUND OF THE INVENTION

This invention relates to lamps, and more specifically to arc discharge lamps, such as fluorescent lamps. More particularly, the invention is applicable to arc discharge lamps that require a very precise amount of a substance to be released in the sealed lamp.

Many methods are currently known for supplying mercury to a fluorescent lamp. For example, patents that generally refer to arrangements for introducing mercury into a lamp include U.S. Pat. Nos. 2,415,895; 3,230,027; 3,300,037; 3,764,842; 4,182,971; 4,335,326; and 4,823,047. As disclosed in many of these patents, the most common methods of introducing mercury to a sealed lamp are mechanical dispensing, use of a mercury-containing amalgam, and release of the mercury from a capsule within the fluorescent lamp.

One drawback to the foregoing apparatus and methods includes the necessity for specialized machinery and equipment. Specialized machinery unfortunately has additional costs associated therewith. Still other ones of these arrangements require specialized lamp components to accommodate the mercury releasing structure. Still further, some of these arrangements have the potential for losing some or all of the substance being charged to the lamp during processing, as well as the presence of unwanted impurities being introduced into the lamp.

The use of a capsule sealed inside the lamp to subsequently release a substance such as mercury resolves some of the foregoing problems. U.S. Pat. Nos. 3,794,402 and 3,794,403, for instance, disclose one arrangement of this type wherein a capsule containing mercury is disposed inside the lamp assembly. The capsule is held against a filament or wire. Upon heating of the wire by induction with the assistance of a primary coil located outside of the lamp, the capsule is ruptured and the mercury released. These patents do not, however, address the problem of premature rupture of the capsule or vessel during other manufacturing and processing steps of the lamp which may cause inadvertent heating of the filament or wire and consequently, premature release of the mercury. This particular arrangement in the '402 and '403 patents also requires a primary coil outside of the lamp that must be accurately aligned with the internal release mechanism. Even having achieved such alignment, reliable mercury dosing is not always possible.

It is an object of this invention, therefore, to provide a device whereby release of a specified substance, such as mercury, to a sealed lamp from a capsule or container within the lamp can be controlled.

It is another object of the invention to provide a means whereby a highly accurate dose of a specified substance is controllably released into a sealed lamp.

It is yet another object of the invention to provide a means for controllably releasing a pre-measured dose of a specified substance into a sealed lamp envelope using minimal current and without employing specialized external equipment or expensive, specially configured lamp components.

Still other objects will become apparent to those skilled in the art upon reading this specification and the attached claims and with reference to the accompanying drawings.

SUMMARY OF THE INVENTION

A means for controllably releasing a pre-measured dosage of a substance inside a hermetically sealed lamp assembly comprises a capsule retained on a temperature sensitive biasing means such as a bi-metal spring for selective tensioned contact with a cutting element. The bi-metal spring behaves in a manner such that upon increase in ambient temperature the spring and the capsule are urged away from and out of contact with the cutting element. Likewise, upon subsequent decrease of the ambient temperature the spring returns to its initial state of tensioned contact against the cutting element.

According to another aspect of the invention, the capsule is easily ruptured or opened to release the contents thereof to the lamp by sending a low amount of current through the cutting element.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein:

FIG. 2 is a cutaway view of a lamp showing the orientation of the electrode mount assembly in FIG. 1;

FIG. 3 is a side elevational view of selected components of the electrode mount assembly shown in FIG. 1 during elevated temperature conditions;

FIG. 4 is a side elevational view of the same components of the electrode mount assembly shown in FIG. 3 under normal temperature conditions; and FIG. 5 is a side elevational view of the same components of the electrode mount assembly shown in FIG. 3 after application of current thereto to release the contents of the capsule.

DETAILED DESCRIPTION OF THE PREFERRED EMBODIMENT

Figure 1:
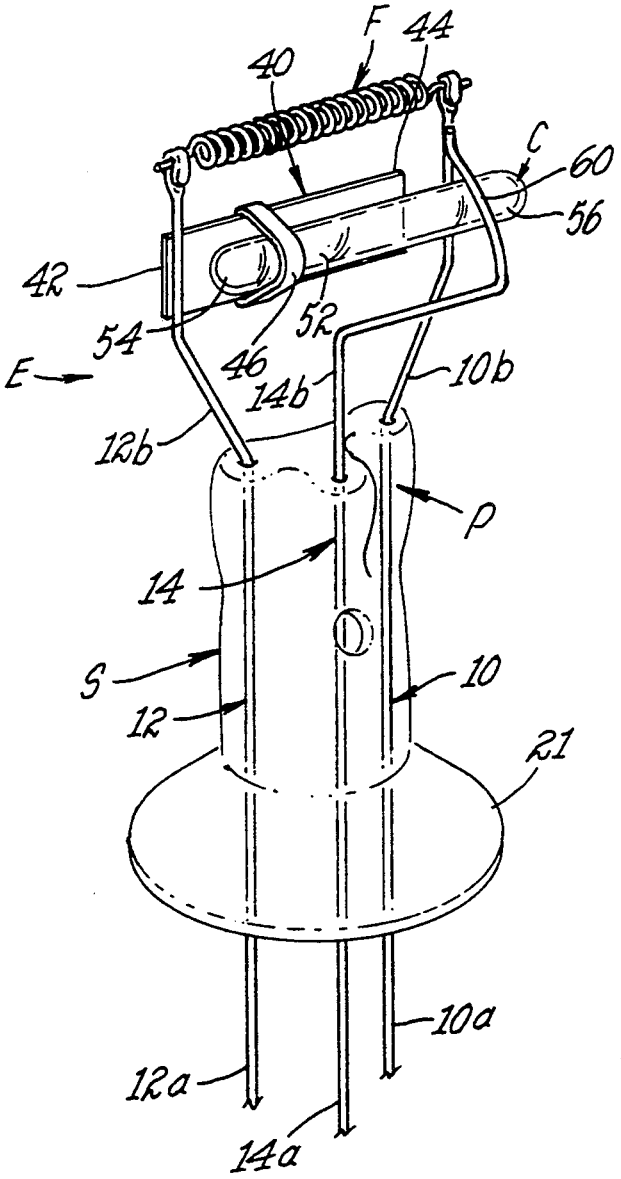
FIG. 1 is a perspective view of an electrode mount assembly according to the subject invention.

Referring now to the drawings wherein the showings are for purposes of illustrating the preferred embodiment of the invention only and not for purposes of limiting same, the Figures show an electrode mount assembly E containing capsule C for an arc discharge lamp that requires a highly accurate amount of a substance to be introduced into the lamp. More specifically, one preferred embodiment relates to a low pressure arc discharge lamp such as a fluorescent lamp which requires a precise amount of mercury to be introduced into the sealed lamp.

As shown in FIGS. 1 and 2, a conventional electrode mount assembly E includes a filament F, which functions as an electrode during operation of the lamp, supported at one end of glass stem S by a hermetic pinch seal P. Seal P can be a shrink seal. Particularly, three lead wires 10, 12, 14 extend through the pinch which hermetically seals the outer ends 10*a*, 12*a*, 14*a* of the wires from inner ends 10*b*, 12*b*, 14*b*. Typically, the stem S is formed of a glass material and may include an evacuation tube or opening (not shown) through which gases may be introduced and evacuated from the lamp. As generally referenced in FIG. 2, the electrode mount assembly E is secured and hermetically sealed to the end of glass lamp envelope 22 by means of glass stem flare 21 as is well known to those skilled in the art. End caps 20 are mounted or secured to each end of lamp envelope 22 so that the external ends of the lead wires of the electrode mount assembly E are eventually electrically connected to conductor pins 26 to complete the electrical circuit with an associated receptacle or socket that receives current from an associated source. Particular details of the end cap arrangement and how it is secured are well known in the art so that further discussion herein is deemed unnecessary.

Moreover, the general structure and operation of a low pressure arc discharge lamp such as a fluorescent lamp is well known in the art. Briefly, ultraviolet light radiation is produced by converting radiation emitted from an arc formed by a mercury vapor contained within glass envelope 22 sealed at opposite ends by a pair of electrode mount assemblies E and end caps 20. An inert starting gas such as argon vapor is also contained within the glass tube. The arc is formed between the electrode assemblies disposed at opposite ends of the tube. Thus, although the second electrode mount assembly is not illustrated, its construction and operation as an anode/cathode arrangement is well known in the art. The ultraviolet radiation emitted from the arc is converted into visible radiation by a coating 24 of a luminescent material such as a phosphor provided on the internal surface of the tubular envelope 22. The coating converts the ultraviolet radiation to visible light radiation in the desired color.

As alluded to above, the-discharge lamp contains an inert gas mixed with another substance such as mercury which, in combination with the desired gas pressure, has a predetermined starting value and lamp life associated with it. Typically, only a small dose or predetermined amount of mercury is required in the lamp. It is oftentimes desired that a very specific, measured amount of mercury be contained within the sealed tube, for example where the lamp is to be used as a calibration tool for calibrating instrumentation that measures the amount of mercury sealed within a lamp, such as a fluorescent lamp. Under prior art arrangements the lamp is filled with mercury via an evacuation tube through the hollow stem portion S of the electrode mount assembly E. It has been found that the mercury dosage could not be accurately controlled, even though it may fall within acceptable tolerances for some applications. Particularly if the lamp is to be used as a calibration tool, it is critical that a predetermined amount of mercury be sealed within the lamp having a known volume and pressure. Accordingly, because of the need for precision and accuracy other arrangements have been developed for mercury dosing.

Again, and as is well known in the art, the manufacture and testing of a lamp undergoes a number of process steps. For example, the glass tubes are washed, rinsed, dried, and coated with the luminescent material. It is, of course, important to control the amount of luminescent material provided on the interior of the glass tube. The coated tube or envelope 22 must be subsequently baked and the electrode mount assemblies located at opposite ends of the glass tube and hermetically sealed to their respective ends of the tube by means of fusing flare portions 21 at the periphery thereof. Air is evacuated from the interior of the lamp and the inert gas is then filled to a desired pressure and the lamp is sealed.

Subsequent process steps often require exposing the lamp to elevated temperatures. It thus became important to closely monitor the mercury releasing means, such as through the above described capsule arrangement, since these elevated temperatures may inadvertently and prematurely release the mercury. In accordance with the subject invention, a device for releasing a very small, highly accurate dose of a specified substance, such as mercury, at a desired time into the interior of an arc discharge lamp is provided.

More particularly, the present invention comprises a means whereby a capsule containing the substance to be charged to the lamp is maintained in a sealed condition until such time as release of the substance is desired. Moreover, the release means is temperature sensitive so that inadvertent, premature release at elevated temperatures does not occur.

In accordance with a preferred embodiment, a three wire electrode assembly incorporates means for releasing the mercury dose. The assembly includes a temperature sensitive arrangement such as a bi-metal element or leaf spring 40. As shown in FIGS. 1 and 2, the bi-metal element 40 is secured to one of the lead wires, in this embodiment the second lead wire at an area intermediately spaced between the filament F and pinch P. The bi-metal element can be secured in any known manner such as spot welding or the like, and is preferably cantilever mounted for reasons which will become more apparent below.

A first end 42 of the bi-metal element is secured to the interior end **12*b* of the second lead wire while a second end 44 of the bi-metal element extends toward the interior end 10*b* of the first lead wire. A securing means defined by one or more retaining straps 46** is used to attach a glass capsule C containing the mercury dose thereto.

The glass capsule C has a sealed cavity 52 that receives the substance to be released to the lamp. Again, for purposes of this preferred arrangement, the substance to be released to a fluorescent lamp is mercury. A very exact, premeasured dose is sealed in the capsule C and then the capsule is fixed on the bi-metal strip 40 by means of retaining strap 46. The bi-metal element and glass capsule are arranged so that a first end 54 of the capsule is secured by the retaining strap 46 while a second end 56 extends outwardly beyond the terminal end of the bi-metal element 40. Thus, as shown, the capsule extends in generally parallel arrangement with the filament, its first end 54 being slightly spaced from the second lead wire **12*b*** while its other end extends outwardly from the bi-metal element.

As illustrated, the preferred arrangement of the invention uses a three wire arrangement, which is well known in the art in other lamp arrangements. Here, the third lead wire 14 has a limited purpose, namely for use as a component of the release means. As shown, the interior end **14*b* of the third lead wire is adapted for abutting engagement with the second end 56 of the capsule under normal temperature conditions. As best illustrated in FIGS. 3–5, the innermost end 60 of the third lead wire defines a cutting means or wire that under normal temperature conditions (FIG. 4) is urged against the capsule. In fact, the bi-metal element 40 urges the capsule C against the cutting wire 60 with a slight biasing force to assure that release of the mercury dose is achieved. It will also be understood, though, that the cutting wire 60 could be a separate element from the third lead wire. That is, according to one arrangement the third wire could be bent in a predetermined manner to define the cutting wire. Alternatively, one end 62 of a separate cutting element can be secured to the third lead wire 14 and a second end 64 of the cutting element secured to the first lead wire 10**.

A primary advantage in using the bi-metal element to retain the capsule is that its temperature sensitive properties can be advantageously used to protect the capsule from premature rupture during manufacture and processing of the lamp. Manufacturing and testing steps require the lamp assembly to be exposed to elevated temperatures. During these processing steps, the ambient temperature may be as high as 500° C. Since the various components of the lamp including the filament and lead wires tend to absorb heat at such temperatures, inadvertent contact between the capsule and these lamp components may prematurely rupture the capsule and release the mercury from the capsule into the lamp. Such an early release may result in loss of a portion or all of the mercury.

The subject invention avoids such a premature release by use of the bi-metal element 40. Not unlike the remaining lamp components such as the lead wires and filament, the bi-metal element also absorbs heat from its surrounding environment. Thus, if the assembly is exposed to elevated temperatures, the bi-metal element will bend in a particular direction. According to the preferred assembly, the bi-metal element 40 bends away from the cutting means 60. The capsule C cannot then be prematurely ruptured by the cutting wire because of the cantilever mounting arrangement and positioning of the second end 56 of the glass capsule away from other components that could otherwise potentially rupture the capsule (FIG. 3) during elevated temperatures. Upon cooling of the lamp assembly environment, the bi-metal leaf spring returns to its initial position (FIG. 4) urging the capsule into tensioned contact with the cutting means.

When it is desired to release the mercury to the sealed lamp, current is provided to the first 10 and third 14 lead wires under normal temperature conditions. Current on the order of 5 amps or less flows through the cutting means 60 and, due to the bias imposed by the bi-metal element, the wire melts the second end 56 of the capsule, and pierces through the capsule end to release the mercury contained in the cavity 52 (FIG. 5) to the sealed lamp. Thereafter, the third lead wire need not be used, and the first and second lead wires are associated with a typical two contact pin fluorescent lamp arrangement to provide current to the filament F. Operation of the fluorescent lamp then proceeds in a normal manner with a highly accurate dose of mercury contained therein.

It will be understood that the capsule C may be tubular or any other shape convenient for use in the lamp. It is preferably constructed of a material which can be ruptured by contact with a heated wire. It is further contemplated that the capsule will be under a slight bias against the cutting wire by the bi-metal element during the rupture or release process. Therefore, opening of the capsule will preferably be a function of temperature to assure that the capsule and cutting wire are urged together when current is passed through the first and third lead wires. Given the foregoing, the capsule material must be a material which will maintain its integrity throughout processing of the lamp, yet will be susceptible to rupture under the above-described conditions. By way of example only, glass is a preferred material of construction for the sealed capsule. Other materials known to those skilled in the art to be suitable for such purposes could also be used.

Because the substance to be charged to the lamp is being supplied from a sealed capsule within the lamp envelope subsequent to sealing of the lamp, there is no opportunity for the substance to escape, or be diluted or contaminated during dosing. Therefore, the amount of the substance provided will be exactly the amount necessary for a given purpose, thereby eliminating the need to provide excess substance and consequently decreasing cost and waste. Further, the substance can be supplied in a pure state, or combined with other elements as desired to suit a particular purpose.

Although the above-described preferred embodiment is particularly directed to release of a mercury dose for a fluorescent lamp, it will be recognized that arc discharge lamps in general may be dosed with other substances. Thus, other substances such as liquid or solid metal halides, amalgams, salts, or a gas, may be desired for a highly accurate dose to a sealed lamp. The bi-metal element employed to retain the capsule and maintain it in tension against the cutting wire through manufacturing and processing steps of the lamp, except under conditions of elevated temperature, is preferably constructed from a nickel steel and nickel-chromium steel combination. Other suitable materials would include those exhibiting two different coefficients of expansion characteristics. Likewise, the cutting wire used to rupture the capsule may be tungsten or another material suited to rupturing of the capsule containing the substance to be charged to the lamp.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

What we claim as new and desire to secure by Letters Patent of the United States is:

1. An apparatus for releasing a predetermined amount of a substance in a sealed arc discharge lamp having first and second electrical lead wires for supplying current from a location outside the lamp into a sealed housing thereof, the apparatus comprising:

a capsule having a chamber defined therein;

a predetermined amount of a substance originally disposed in said capsule chamber for subsequent release into the housing;

a cutting means .adjacent said capsule for melting and opening said capsule in response to current selectively supplied thereto to release said substance in said capsule chamber into the housing; and a temperature sensitive means connected to the capsule for urging said capsule and said cutting means apart in response to an elevated temperature.

2. An apparatus as defined in claim 1 wherein said temperature sensitive means also urges said capsule and cutting means together in response to a reduction in temperature from the elevated temperature.

3. An apparatus as defined in claim 1 wherein said temperature sensitive means biases said capsule and said cutting means together under temperature ranges below said elevated temperature.

4. An apparatus as defined in claim 1 wherein said temperature sensitive means includes a bi-metal element secured to said capsule.

5. An apparatus as defined in claim 4 wherein said first electrical lead wire is commonly connected to a filament of the lamp and said cutting means.

6. An apparatus as defined in claim 5 wherein said second lead wire is electrically connected to said filament.

7. An apparatus as defined in claim 6 further comprising a third electrical lead wire connected to said cutting means.

8. An apparatus as defined in claim 7 wherein said first and third electrical lead wires mount said cutting means in tension against said capsule under temperature ranges below said elevated temperature.

9. An apparatus as defined in claim 7 wherein said third wire is adapted for selectively supplying electrical current from a location outside the lamp to said first and third wires to heat said cutting means and open said capsule.

10. An apparatus for controllably releasing a premeasured dosage of a substance to a hermetically sealed arc discharge lamp having an electrode mount assembly comprising a capsule retained on a bi-metal spring and in tensioned contact with a cutting means, said bi-metal spring behaving in a manner such that, upon increase in temperature, said spring moves said capsule away from and out of contact with said cutting means and upon subsequent decrease in temperature said spring returns the capsule to its initial state of contact and tension against said cutting means, said substance originally disposed in said capsule for subsequent release into said lamp, said cutting means opening said capsule in response to a current selectively Supplied thereto to release said substance in said capsule into said lamp.

11. An apparatus as defined in claim 10 wherein said electrode mount assembly includes a three wire arrangement, said first and third wires being adapted for selectively. Supplying electrical current from a location outside said lamp to heat said cutting means and melt and open said capsule.

12. An apparatus as defined in claim 11 wherein said first and second wires are adapted for supplying electrical current from a location outside of said lamp to heat a filament of said lamp.

13. An apparatus as defined in claim 10 wherein said bi-metal spring has one end mounted to said second wire and a freely suspended second end that disposes the capsule against said cutting means.

14. A device for releasing a dosage of mercury into a sealed arc discharge lamp comprising a capsule containing said mercury and a cutting means against which said capsule is held in tension, said cutting means, upon receiving a minimal current by direct coupling, melting, and opening said capsule to release said mercury into said sealed lamp, wherein said capsule is attached to a bi-metal element which moves away from said cutting means in response to heat generated during manufacture of said lamp, said bi-metal element returning said capsule to tensioned contact against said cutting means upon cooling.

* * * * *